United States Patent [19]

Fisher et al.

[11] 3,964,724

[45] June 22, 1976

[54] TRAVERSE WINDING METHOD

[75] Inventors: Don E. Fisher; Paul A. Knauff; David Bowen, Jr., all of Pensacola, Fla.

[73] Assignee: Monsanto Company, St. Louis, Mo.

[22] Filed: Nov. 2, 1970

[21] Appl. No.: 85,930

Related U.S. Application Data

[62] Division of Ser. No. 798,082, Feb. 10, 1969, abandoned.

[52] U.S. Cl. ..... 242/43 R; 242/18.1

[51] Int. Cl.[2] ..... B65H 54/30

[58] Field of Search ..... 242/43, 43.1, 18 R, 242/18 DD, 18.1

[56] References Cited

UNITED STATES PATENTS

| | | | |
|---|---|---|---|
| 2,388,557 | 11/1945 | Little et al. | 242/43 |
| 3,097,805 | 7/1963 | Oberly | 242/43 |
| 3,113,736 | 12/1963 | Emerson | 242/43 |

FOREIGN PATENTS OR APPLICATIONS

| | | | |
|---|---|---|---|
| 552,207 | 3/1943 | United Kingdom | 242/43 |

*Primary Examiner*—Stanley N. Gilreath
*Attorney, Agent, or Firm*—Kelly O. Corley

[57] ABSTRACT

The invention relates to high-speed yarn traverse winding apparatus, method and product.

Circling thrust members are provided to intercept a yarn being reciprocably traversed and forwarded to a bobbin in a winding zone to acceleratively control the reversal displacement of the yarn on the bobbin. A yarn package having a high resolution of symmetry is produced, the package being characterized in that the majority of the reversal curves of the helical windings are comprised essentially of camber curves generated substantially to a point of projected intersection of the diagonal linear extensions of the helical windings.

4 Claims, 16 Drawing Figures

INVENTORS
D.E. FISHER
P.A. KNAUFF
D. BOWEN

INVENTORS
D.E. FISHER
P.A. KNAUFF
D. BOWEN

TRAVERSE WINDING METHOD

BACKGROUND OF THE INVENTION

This is a division of our copending patent application Ser. No. 798,082 filed Feb. 10, 1969, now abandoned.

The objective of the invention is to improve upon present textile traverse winding machines and methods to permit use of higher operational speeds and to produce more precisely wound, improved yarn packages.

Conventionally, a yarn package is formed by traversing a yarn linearly across the face of a bobbin being driven at a constant peripheral speed so that the yarn is taken up in helically displaced windings or wraps. Yarn traversing is effected by a reciprocating guide slidably constrained to move linearly between guide surfaces and driven by an attached cam follower to which motion is imparted by a grooved barrel roll cam. The speed of reversal of the reciprocating guide is controlled by the angularity of the curve of the cam groove in the reversals. Sharp cam curves provide faster reversals but they subject guide-follower assemblies to excessive disintegrating accelerative loads. Therefore, the degree of angularity that may be employed in profiling a reverse cam groove curve is restrictive. Consequently, at high speeds of reciprocation, conventional barrel roll traverse devices inherently operate at slower speeds in the reversals. A typical high-speed yarn packaging process may require traversing speeds of 600 or more cycles per minute and yarn take-up speeds of 2000 or more yards per minute.

A yarn package produced by a traverse device operating at slower speeds in the reversals has more yarn per unit of package length deposited on the ends. The result is a package having a reduced central diameter portion and raised or bulged larger diameter end portions. The bulged ends are hard compared to the intermediate portion, and particularly in a winding operation where a bobbin is driven surfacely by a conventional peripheral bobbin drive assembly, the hardness differential progressively increases as the package is built to a larger diameter. Variations in package hardness are undesirable and are known to be a cause of streaking when the packaged yarn is subsequently converted into fabric and dyed. Hardness variations in a yarn package may also cause tension barre' in fabric production.

A further unsatisfactory feature of conventional traverse winding apparatus is the relatively long trail length of yarn required in operation. The "yarn trail length" is that free length of yarn traveling from the point of contact with a traverse guide or surface and the first point of contact with a take-up bobbin or associated wind-up roll such as a drive roll. Since the yarn trail length is a free running length of yarn, it is subject to undesirable vibration and tension fluctuations that increase in magnitude with an increase in the trail length of yarn. Ideally, the shortest attainable yarn trail length is desirable.

Suggestions to accelerate the traversing of a yarn in the reversals are disclosed in patents issued to R. Y. Hays, U.S. Pat. No. 3,059,874; P. J. Chaussy, U.S. Pat. No. 3,089,657; and L. A. Oberly, U.S. Pat. No. 3,097,805. The invention herein provides still another different solution for controlling a traversing yarn in the reversals.

It is an object of this invention to provide a yarn traverse apparatus having a reciprocating guide to produce the main span of a linear traversal of yarn, and synchronously driven circulating guides to produce the traverse reversals.

It is an object to provide a traverse winding method wherein a linearly traversing yarn is engaged in the reversals to effect a controlled, constantly decreasing trail length and, simultaneously, an accelerative lateral displacement thereof.

Another object is to provide a yarn package having the yarn distributed around a bobbin in helices comprising substantially linear, diagonally extending lengths joined at the ends of the package by reversal curves. The majority or most of the reversal curves are characterized by being essentially camber curves generated around linear projections of the diagonal lengths and extending substantially to the point of projected intersections of the latter.

BRIEF SUMMARY OF THE INVENTION

The traverse winding apparatus and method comprise traverse means for traversingly displacing a yarn being forwarded to and being taken up on a driven bobbin. The yarn is traversed back and forth at a substantially constant rate of speed with an exception of a reduction in traverse speed in the reversals. A pair of camming pins or guides are arranged between the point of reciprocation of the yarn and the bobbin and are adapted to circulate angularly relative to the plane of traversal of the yarn. Each pin is located in the reversal zone of the traversing yarn and is driven to circulate at a faster relative speed than the rate of traversal of the yarn in the reversal. Before the traversing yarn reaches the limits of its strokes, each pin is synchronized to smoothly contact the yarn and to impart an arcuate, sliding thrust against the yarn applying a sideward and downward vectorial component thereto. The thrust applied accelerates and increases the lateral displacement of the yarn, shortens the trail length and cooperatively with the traverse means effects a reversal of the yarn. The pins are synchronized to disengage from the yarn after the yarn has been reversed by the traverse means and substantially established a predetermined reverse trail angle.

The term "yarn trail angle" refers to the angle formed between the free trail length of yarn and a peripheral line of contact of the yarn on a rotating roll traced as the yarn is traversed back and forth across the roll. In general the rotating roll may be a bobbin, drive roll or bail roll and is the first roll contacted in the wind-up assembly. Commonly, a yarn will have a constant trail angle in one direction of traverse and a similar reverse constant trail angle in the opposite direction of traverse. In the reversal periods, the yarn trail length passes through a reversal arc from one to the reverse constant trail angle and through a perpendicular or 90° trail angle position. Yarn trail angles $\theta A$ and $\theta B$ are illustrated in FIGS. 3 and 12, respectively, in the accompanying drawings.

The yarn package produced has a high resolution of geometric symmetry and physical property uniformity. The windings on the yarn packages are laid in helices having reversal curves that are comprised essentially of camber curves built about projected, theoretical angular "V" reversals.

DESCRIPTION OF PREFERRED EMBODIMENTS

Figure 1:
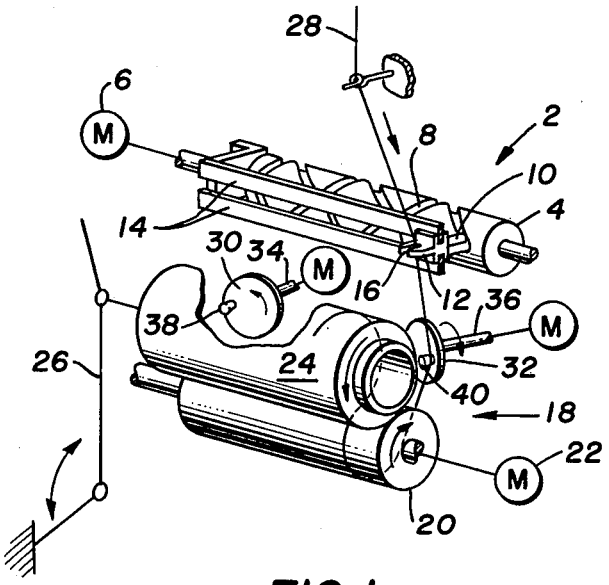
FIG. 1 is a perspective view with portions broken away illustrating the traverse winding apparatus of the invention.
Figure 2:
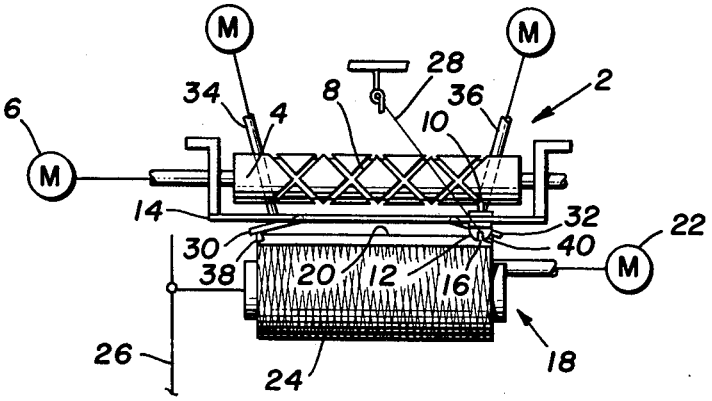
FIG. 2 is a plan view of the traverse winding apparatus.

Referring to FIGS. 1 and 2 of the drawings, the traverse winding apparatus embodying the invention comprises a conventional primary yarn traverse device 2 including a barrel roll 4 driven by a motor 6, and a helical cam groove 8. Cam groove 8 imparts motion to a cam follower 10 positioned slidably in cam groove 8. A yarn guide 12 is connected to cam follower 10 and forms a traverse guide that is constrained to travel slidably in a longitudinal slot provided between spaced guide rails 14. Yarn guide 12 has a yarn slot 16 and, operatively, reciprocates back and forth between guide rails 14. This primary yarn traverse device accordingly traverses the yarn back and forth between reversals in one zone or region.

A conventional yarn winding, collecting or take-up device 18 is positioned below traverse device 2. Winding device 18 includes a drive roll 20 driven by a motor 22, and a bobbin 24 mounted rotatably on a pivotal bobbin chuck assembly 26, illustrated schematically. Bobbin 24 is pivotally movable toward and away from drive roll 20 and, in operation, rests on the drive roll in parallel, axial alignment therewith. Reference numeral 24 identifies both the yarn package and bobbin. Device 18 accordingly collects the traversing yarn in a second region or zone.

A yarn 28, forwarded to traverse device 2, is laced to pass through yarn slot 16 and to extend engagingly around the bottom of drive roll 20, FIG. 1, before passing through the nip between drive roll 20 and bobbin 24. Drive roll 20 is driven in one direction to drive bobbin 24 in the opposite direction. If desired, an alternate lace-up where yarn 28 extends directly through the nip between drive roll 20 and bobbin 24 may be used rather than lacing the yarn initially around drive roll 20.

A secondary traverse mechanism, including pins mounted on a pair of rotatably driven discs, 30 and 32, is positioned between yarn guide 12 and drive roll 20. The discs are symmetrically arranged in lateral, spaced relation closely adjacent to drive roll 20. Each disc has a frontal side facing drive roll 20, and each is driven by a shaft 34 and 36, respectively, from the back side thereof in opposed directions. Disc 30 rotates in a counterclockwise direction while disc 32 rotates in a clockwise direction, FIG. 1. Discs 30 and 32 are positioned upstandingly and in opposed oblique relation relative to the plane of traversal of the yarn so that their frontal sides angularly face each other.

Each disc 30 and 32 has a post or pin 38 and 40, respectively, projecting from its frontal side. Each pin 38 and 40 is positioned a predetermined distance from the axis of rotation of its respective disc, and each extends substantially perpendicularly from the frontal side thereof. Preferably, the pins are tapered and if desired they may be mounted rotatably. Discs 30 and 32 are positioned to circulate pins 38 and 40 laterally beyond the reversal limits of the yarn guide slot 16.

Pins 38 and 40 constitute secondary traverse devices and cooperate with the primary traverse and winding devices 2 and 18, respectively, to operate in the following manner. Assume yarn 28 is being traversed by yarn guide 12 and is traveling under tension to and being taken up on bobbin 24, and that discs 30 and 32 are driven to circulate pins 38 and 40 at a predetermined higher rate of speed than a selected linear rate of traversal of guide 12. Accordingly then, each pin 38 and 40, traveling at a high speed of rotation or circulation in a plane oblique relative to the plane of traversal of yarn 28, contacts the yarn while the yarn guide 12 is in a reduced speed reversal either before or after the exact moment of guide 12 reversal depending on whether a lower or higher ratio of pin 38 and 40 revolutions to yarn guide 12 cycles is employed. During its contact with the yarn, each pin 38 and 40 slidingly engages the yarn through an arcuate degree of circulating motion of the pin and applies an outward lateral thrust thereto displacing the yarn beyond the outer limit of displacement of the yarn by reciprocating guide 12. Each pin 38 and 40 disengages from the yarn 28 substantially at a time coincident with the yarn guide 12 having made a reversal and having regained its normal constant speed of traversal. The length of the yarn traversal stroke normally provided by yarn guide 12 is extended or lengthened by pins 38 and 40 without varying the normal rate of periodic traversal of the yarn by guide 12 because pins 38 and 40 accelerate the displacement of the yarn through the reversals. It is to be understood that the location of pins 38 and 40 on discs 30 and 32, the size of pins 38 and 40, the determined oblique angularity of discs 30 and 32, the positioning of the discs relative to the yarn winding roll or rolls, and the ratio of yarn guide cycling speed to pin rotational speed may be varied to provide a multiplicity of operative solutions.

Figure 3:
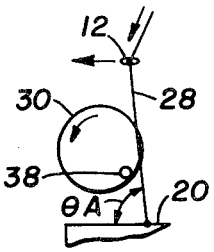
FIGS. 3-12 are elevation views schematically illustrating a sequential operation of a circulating pin component of the invention.
Figure 6:
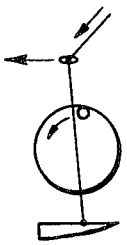
Figure 9:
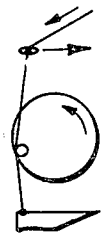
Figure 12:
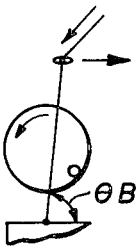
Figure 4:
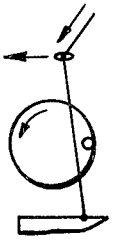
Figure 7:
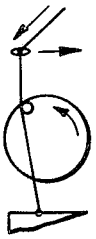
Figure 10:
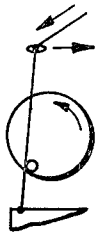

Referring to FIGS. 3 –12, assume that traverse guide 12 is traversing the yarn leftwardly at an established constant trail angle, $\theta A$, FIG. 3, and that the yarn is approaching pin 38 which is circulating in a counterclockwise direction. Because of the oblique angularity of disc 30, the yarn moving leftwardly first passes freely across the path and in front of pin 38, FIG. 3. Pin 38 having a high rate of rotational speed rapidly catches up with and contactingly intercepts the yarn, FIGS. 6–7, before yarn guide 12 reaches the end of its leftward stroke. Pin 38 applies a leftward accelerative thrust against yarn 28 and causes the yarn to course angularly around the surface of pin 38 in traveling to drive roll 20, FIGS. 8–9. Yarn guide 12 reaches the limit of its leftward stroke, and after reversing, FIG. 7, carries the contacted yarn portion rightwardly while pin 38 continues to push against the yarn and to displace the yarn leftwardly. Pin 38 applies horizontal leftward and vertical downward velocity displacement components to the yarn as the latter is traversed across drive roll 20. The downward velocity displacement component is effected because the yarn travels angularly under pin 38 due to the established trail angle of the yarn as it moves leftwardly. Even after pin 38 reaches and passes its leftmost position (between the positions shown in FIGS. 8 and 9), the downward velocity displacement component continues shortening the trail length and driving the yarn leftward. At the position shown in FIG. 9, pin 38 has acquired a small component of motion to the right, but the still substantial downward component continues to drive the yarn to the left. Shortly after the FIG. 9 position, θA becomes 90° because the effect of the now rapidly increasing rightward component. As pin 38 travels from the position shown in FIG. 9, and the yarn passes through and beyond the vertical position, the downward component of motion continues to cooperate in effecting rapid reversal. Thus, the continuing reduction in trail length enhances the effect of the increasing rightward movement of pin 38, since the same amount of rightward movement at a smaller distance from roll 20 corresponds to a more rapid angular charge of the yarn at the reversal. Thus, establishment of the proper reverse trail angle θB is accomplished more rapidly than in prior art devices wherein the trail length is not decreased during and after the point wherein θA becomes 90°. Pin 38 reaches a lower point of circular travel and because of the high pin velocity and oblique angularity of disc 30, pin 38 is carried out of the plane of traversal of the yarn and disengages therefrom, FIGS. 10–12. At approximately the time of disengagement of pin 38 from yarn 28, FIG. 10, the yarn will have substantially assumed the correct reverse trail angle, θB, FIG. 12. Pin 38 is arranged and synchronized to disengage from the yarn, preferably, and approximately at the moment yarn guide 12 passes through its slower reversal phase and has reached its normal speed of travel rightwardly.

It will be noted that pin 38 while contacting the yarn establishes a progressively diminishing shortened trail length because of the moving arcuate contact of pin 38 with the yarn, the trail length being considered that length extending from the point of contact with pin 38 to the point of contact with roll 20. This continuously shortening trail length provides more effective control of the yarn in the reversals.

The displacement of the yarn at the point of contact with pin 38 may be described as circular, harmonic motion displacement or as sinusoidal. The velocity of displacement of the yarn through the reversal at the point of contact of the yarn with drive roll 20 as controlled by pins 38 and 40 may be described as the sum of the sideward or horizontal, and downward or vertical displacement component being a function of the interaction between the trail angle (θA and θB) of the yarn and a respective pin.

The invention may be operated at high speeds to provide superior, stable yarn packages. Traverse speed differential between pins 38 and 40 and yarn guide 12 should, for a 9-1/2 inch primary traverse stroke, be in the range of 6 to 15 cycles or revolutions of the pin to one cycle of guide 12 where one back and forth displacement of guide 12 equals one guide 12 cycle.

In one workable arrangement, a yarn was taken up at 3000 yards per minute and the yarn guide 12 was adapted to traverse at 900 cycles per minute. Discs 30 and 32 had pins 38 and 40 arranged approximately one inch from the center or axis of rotation thereof, and the discs were driven to circulate the pins at approximately 7200 revolutions or cycles per minute. Pins 38 and 40 had a length and a diameter of approximately ¼ inch. The discs were angled to cause pins 38 and 40 to engage and disengage from the yarn substantially as illustrated in FIGS. 3–12.

It will be understood that for different processing conditions operational adjustments may be required to synchronize the pin 38 and 40 rotation, circulation or revolution with the yarn guide 12 reciprocation to provide engagement and disengagement of the yarn in the reversals substantially as explained before.

The yarn packages produced have a high resolution of cylindricity and a uniform compaction of yarn linearly and radially of the package. Typical surface end bulges do not appear on the packages. Dye tests conducted comparing yarn packaged according to the invention with yarn packaged conventionally without thrust pins 38 and 40 indicated an appreciable reduction in the incidence of dye streaks in the yarn packaged according to the invention. Dye streaks are areas of uneven coloration.

Figure 13:
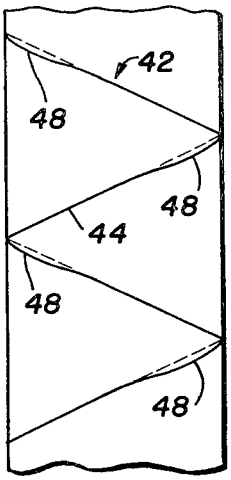
FIG. 13 is a developed view of several helical traversals of yarn wound on a bobbin illustrating the camber curve provided in the reversals.
Figure 5:
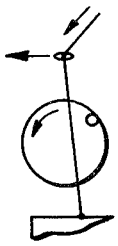
Figure 8:
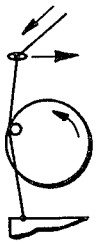
Figure 11:
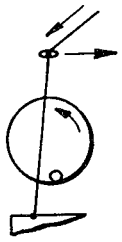

The yarn package comprises a multiplicity of wraps or windings comprised of helical segments or helices 42 illustrated in a developed view in FIG. 13. For illustrative purposes the helices 42 are compressed. Helices 42 have linear diagonal lengths 44 that are wound or laid on the package at a substantially constant helix angle with connecting reversal curves 46 formed according to the invention and illustrated on a larger scale in FIGS. 14–16.

According to the invention, a reversal curve 46 is characterized in that essentially most or the greater portion of the curve consists of a camber curve 48 or convex curve built about a linear projection or extension 50 of a diagonal length 44 of the winding to the end of the package. The camber curved portion 48 is the first laid portion of yarn on the package at each reversal curve and extends, preferably, and substantially to the apical point of intersection 52 of linear extensions 50 of adjacent diagonal lengths 44.

The reversal curves 46 closely simulate an ideal, angular "V" reversal. It will be noted that the camber curved portions 48 of the reversal curves 46 comprise the major segment of the reversal curves 46, and that one diagonal length 44 extends linearly a greater distance to the end of the package than the adjacent diagonal length 44 having the camber curve 48 developed at its end thereof. The preciseness of right-circular cylindricity and improved quality of the yarn produced by the invention is attributed to the improved control of the trail length of the yarn in the traverse reversals, and to the specific reversal curve 46 achieved on the yarn package by the velocity and displacement pattern of the yarn in the traverse reversals, as described.

Figure 14:
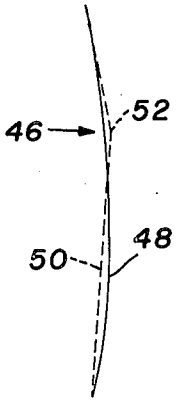
FIGS. 14-16 are developed views illustrating several different configurations of a reversal curve wound or laid on a bobbin according to the invention.
Figure 15:
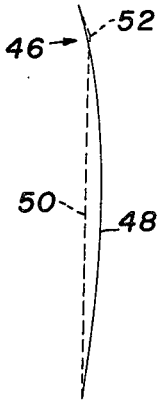
Figure 16:
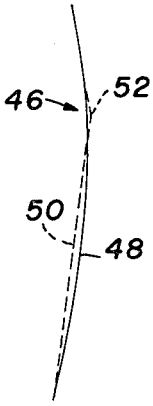

Since it is known that yarn wraps on a yarn package are not laid superimposed one on top of the other and that the yarn wraps slip into position between other wraps during the winding process, variations in configuration of the reversal curves 46 will normally be apparent as indicated in FIGS. 14–16. However, according to the invention, the majority of the reversal curves 46 will possess the camber curve 48, as described and illustrated.

It will be understood that variations in the form of rotating cams, or rotating arms and other yarn traversing structures may be used for the disc and pin arrangement illustrated herein.

The term "yarn" as used herein is intended to cover other similar strandular structures, and the term "bobbin" is intended to cover the various types of holders and cores used for collecting strand materials.

We claim:

1. A traverse winding method comprising the steps of:

a. traversing a yarn in a traverse plane back and forth between reversals in one zone of said traverse plane;

b. collecting the traversing yarn in a second zone of said traverse plane;

c. during said reversals, engaging said traversing yarn with a secondary traverse device between said one and said second zones whereby said yarn forms a trail angle and a trail length between said secondary traverse device and said second zone; said trail angle varying from a first given value in a first direction at the beginning of a reversal period through 90° to a second given value in the opposite direction at the end of said reversal period; and d. decreasing said trail length during at least part of the period beginning when said trail angle becomes 90° and ending when said trail angle reaches said second value, said step of decreasing being accomplished by moving said secondary traverse device toward said second zone after said trail angle has become 90°.

2. The method defined in claim 1, wherein said secondary traverse device moves in simple continuous rotary motion during the entire period during which said secondary traverse device contacts said strand.

3. The method defined in claim 2, wherein said secondary traverse device moves in a plane oblique to said traverse plane.

4. A method for winding a yarn, comprising:

a. traversing said yarn back and forth between reversals in a first plane;

b. collecting the traversing yarn in a collection zone;

c. during said reversals, engaging said yarn with a secondary traverse device continuously rotating about an axis and in a second plane obliquely intersecting said first plane whereby said secondary traverse device repetitively moves into and out of said first plane;

d. said secondary traverse device rotating in a direction such that, during substantially the entire intervals when said secondary traverse device engages said yarn, said traverse device has a component of motion toward said collection zone, whereby the trail length between said secondary traverse device and said collection zone is decreased during said reversals.

* * * * *